US006776472B2

(12) United States Patent
Itano et al.

(10) Patent No.: US 6,776,472 B2
(45) Date of Patent: Aug. 17, 2004

(54) INK JET RECORDING APPARATUS AND FLUSHING PROCESS FOR INK JET RECORDING APPARATUS

(75) Inventors: Masaaki Itano, Nagano (JP); Koji Morikoshi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/330,031

(22) Filed: Dec. 26, 2002

(65) Prior Publication Data

US 2004/0085390 A1 May 6, 2004

(30) Foreign Application Priority Data

Dec. 28, 2001 (JP) ..... P.2001-399828

(51) Int. Cl.[7] ..... B41J 2/165

(52) U.S. Cl. ..... 347/35; 347/29; 347/33; 347/32; 347/36

(58) Field of Search ..... 347/22–36

(56) References Cited

U.S. PATENT DOCUMENTS

| | | | | | |
|---|---|---|---|---|---|
| 5,182,582 | A | * | 1/1993 | Okamura | 347/33 |
| 6,050,671 | A | * | 4/2000 | Rotering | 347/35 |
| 6,257,696 | B1 | * | 7/2001 | Nakamura | 347/30 |
| 6,312,089 | B1 | * | 11/2001 | Imai | 347/24 |
| 6,527,361 | B1 | * | 3/2003 | Gotoh et al. | 347/30 |
| 6,619,783 | B2 | * | 9/2003 | Kanaya et al. | 347/35 |

FOREIGN PATENT DOCUMENTS

JP 8 169155 7/1996

* cited by examiner

*Primary Examiner*—Shih-wen Hsieh
(74) *Attorney, Agent, or Firm*—Ladas & Parry

(57) ABSTRACT

The present invention provides a flushing process for an ink jet recording apparatus that employs inks using pigments as coloring agents and moves a recording head along a guide shaft to flush the inks to flushing portions of a platen, in which a first flushing for flushing one of dark pigment ink(s) and light pigment ink(s) and a second flushing for flushing the other of the dark pigment ink(s) and the light pigment ink(s) are performed onto the same positions of the platen. Also provided is an ink jet recording apparatus that performs the flushing process.

2 Claims, 4 Drawing Sheets

INK JET RECORDING APPARATUS AND FLUSHING PROCESS FOR INK JET RECORDING APPARATUS

FIELD OF THE INVENTION

The present invention relates to an ink jet recording apparatus employing inks in which pigments are used as coloring agents and to a flushing process for the ink jet recording apparatus. More particularly, the invention relates to an ink jet recording apparatus for flushing dark pigment inks and light pigment inks onto flushing portions (boxes) and a flushing process for the ink jet recording apparatus.

BACKGROUND OF THE INVENTION

As the ink jet recording apparatus in the background art, there is an apparatus that performs the flushing. In such apparatus, the flushing is performed every color at respective positions pursuant to the alignment of head nozzles.

The ink jet recording apparatus is constructed, for example, as shown in JP-A-8-169155 (FIG. 4).

Here, pigment inks 104 (a black ink 104A and color inks 104B to 104G) are provided to a recording head 101. As shown in FIG. 5, the color inks 104B to 104G include dark/light cyan inks 104B, 104C, dark/light magenta inks 104D, 104E, and dark/light yellow inks 104F, 104G.

These inks 104A to 104G are ejected from respective nozzles 103 (103A, 103B, 103C, 103D, 103E, 103F, 103G) of the recording head 101.

Meanwhile, in order to prevent the clogging of respective nozzles 103A to 103G of the recording head 101, as shown in FIG. 5, the recording head 101 is caused to move to a flushing box position on the outside of a left end edge 102A of a recording paper 102, for example, every time when the recording head 101 performs the reciprocating movement several times (4 to 5 times) along a main scanning direction indicated by the arrow A, and then the inks 104A to 104G are caused to eject (flush) from respective nozzles 103A to 103G.

The flushed inks 104A to 104G are allowed to penetrate into flushing portions (boxes) of a platen 105.

However, in the case where inks using pigments as the coloring agents are employed, a moisture contained in the inks 104A to 104G evaporates to start precipitation of the pigment solid components of the inks 104A to 104G, depending on the operating circumstances of the ink jet recording apparatus, particularly by a room temperature rise caused, for example, in the summer season.

In particular, weight percents of pigment solid components in the dark pigment inks 104B, 104D, 104F of cyan, magenta and yellow are higher rather than the light pigment inks 104C, 104E, 104G. The concentrations of the pigment solid components in the light pigment inks are ½ or less of the dark pigment inks in terms of weight %.

For this reason, as shown in FIG. 5, in some cases the dark pigment inks 104B, 104D, 104F of cyan, magenta and yellow cannot penetrate sufficiently into the flushing portions (boxes) of the platen 105. Thus, the pigment solid components of the dark pigment inks 104B, 104D, 104F of cyan, magenta and yellow are deposited on the surface of the platen 105 as the so-called piled-up sediment 106.

In this manner, once the piled-up sediment 106 is generated on the surface of the platen 105, the deposition proceeds. At a certain time when the recording head 101 comes to the flushing position, such piled-up sediment 106 rubs nozzle surfaces of the recording head 101 to cause the defective ejection.

SUMMARY OF THE INVENTION

The present invention has been made in view of the above problems, and it is an object of the present invention to provide an ink jet recording apparatus and a flushing process capable of allowing flushed dark inks to sufficiently penetrate into a platen when inks that use pigments as coloring agents are employed.

Other objects and effects of the invention will become apparent from the following description.

In order to achieve the above object, the present invention provides an ink jet recording apparatus that moves a recording head along a guide shaft to flush inks to flushing portions of a platen when employing inks using pigments as coloring agents, the ink jet recording apparatus having a feature that the recording head performs a first flushing for flushing one of dark pigment ink(s) and light pigment ink(s) and a second flushing for flushing the other of the dark pigment ink(s) and the light pigment ink(s) onto the same position(s) of the platen.

Also, the present invention provides a flushing process for an ink jet recording apparatus that employs inks using pigments as coloring agents and moves a recording head along a guide shaft to flush the inks to flushing portions of a platen, the flushing process having a feature that a first flushing for flushing one of dark pigment ink(s) and light pigment ink(s) and a second flushing for flushing the other of the dark pigment ink(s) and the light pigment ink(s) are performed onto the same position(s) of the platen.

Here, the first flushing and the second flushing may be carried out as follows: the dark pigment ink is firstly flushed, followed by the flushing of light pigment ink to cover the flushed dark pigment ink, or alternatively, the light pigment ink is firstly flushed, followed by the flushing of dark pigment ink to cover the flushed light pigment ink. In short, to implement the present invention, the order of flushing of the dark pigment ink and the light pigment ink may be set arbitrarily and selected appropriately.

Also, as the first flushing and the second flushing, it is not necessary to flush the dark pigment ink and the light pigment ink alternately by the same times. Specifically, the light pigment ink may be flushed several times after the dark pigment ink is flushed only once, or the dark pigment ink may be flushed several times after the light pigment ink is flushed only once.

In addition, if the black ink and the color inks are employed, the dark pigment ink and the light pigment ink in the present invention do not necessarily have the same hue mutually. For example, the dark pigment ink of cyan and the light pigment ink of yellow may be flushed onto the same position of the platen in any order.

In the ink jet recording apparatus and the flushing process for the ink jet recording apparatus that are constructed in this manner and employ the inks using the pigments as the coloring agents, the first flushing for flushing one of the dark pigment ink(s) and the light pigment ink(s) and the second flushing for flushing the other of the dark pigment ink(s) and the light pigment ink(s) are performed onto the same position(s) of the platen.

The weight percents of the pigments in the light pigment inks are lower than those in the dark pigment inks. Therefore, for example, in the case that the light pigment ink is to be flushed after the dark pigment ink is flushed, the solvent components constituting the light pigment ink prevent further deposition of the pigment solid components of the dark pigment ink as the piled-up sediment. The dark pigment ink deposited as the piled-up sediment and the light pigment ink are mixed, making it possible to penetrate both together into the flushing portion (box) of the platen.

On the contrary, for example, in the case that the dark pigment ink is to be flushed after the light pigment ink is flushed, the dark pigment ink is mixed with the solvent components constituting the light pigment ink previously penetrated into the flushing position of the platen. Thereby, not only the precipitation of the pigment solid components in the dark pigment inks on the platen can be suppressed, but also the dark pigment ink can be allowed to penetrate into the flushing portion (box) of the platen. As a result, the deposition of the dark pigment inks on the surface of the flushing portions (boxes) as the piled-up sediments can be prevented.

DETAILED DESCRIPTION OF PREFERRED EMBODIMENT

An embodiment according to the present invention will be explained in detail with reference to the drawings hereinafter. In respective embodiments explained in the following, explanation of members, etc. that are already explained with reference to FIG. 1 will be simplified or omitted by allotting the same symbols or equivalent symbols in Figures.

Figure 1:
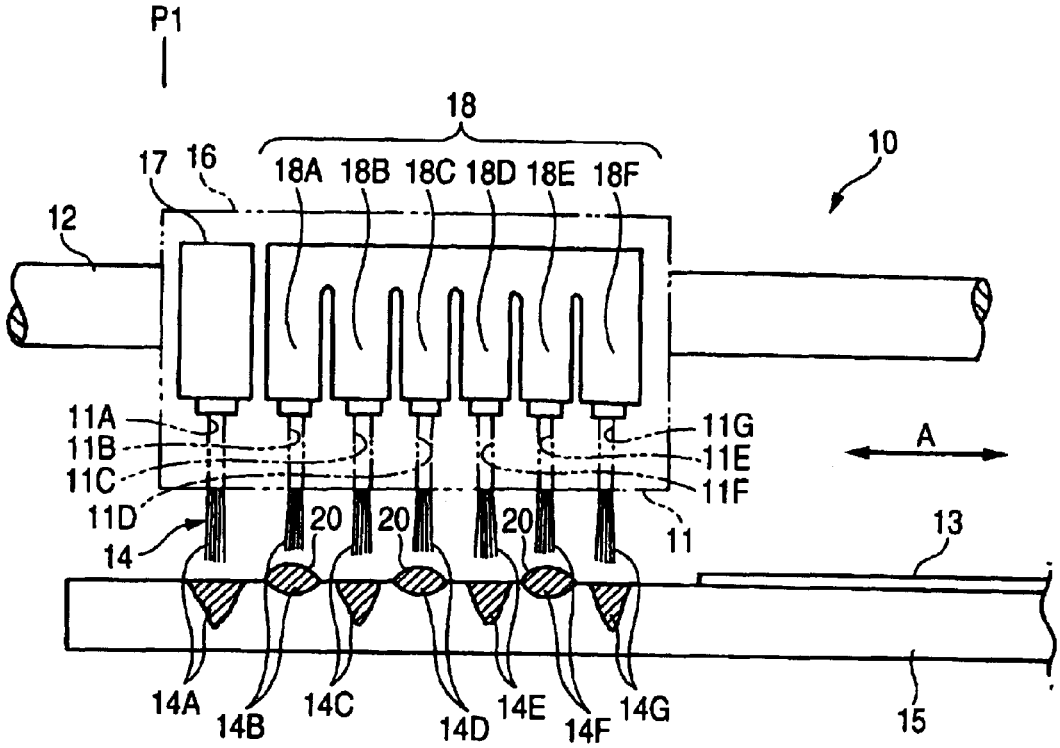
FIG. 1 is an explanatory view showing an ink jet recording apparatus according to the present invention.

As shown in FIG. 1, an ink jet recording apparatus 10 according to the present invention, in which inks each using a pigment as the respective coloring agent are employed, is constructed such that a recording head 11 is caused to move to flushing portions along a guide shaft 12 every time when the recording head 11 performs its reciprocating movement several times (4 to 5 times) along a main scanning direction indicated by the arrow A, and then dark pigment inks 14B, 14D, 14F and light pigment inks 14C, 14E, 14G out of pigment inks 14 (14A to 14G) are caused to flush to the flushing portions of the platen 15.

A carriage 16 is provided to the recording head 11, and this carriage 16 is fitted movably to the guide shaft 12. Thus, the recording head 11 can be scanned along the guide shaft 12.

As the inks, those using pigments as the coloring agents are employed.

A black ink cartridge 17 and color ink cartridges 18 are detachably attached to the carriage 16. An end of the black ink cartridge 17 is communicated with a nozzle 11A of the recording head 11.

Also, dark/light cartridges 18A, 18B for cyan, dark/light cartridges 18C, 18D for magenta, and dark/light cartridges 18E, 18F for yellow are provided to the color pigment ink cartridge 18. Ends of respective cartridges 18A, 18B, 18C, 18D, 18E, 18F are communicated with respective nozzles 11B, 11C, 11D, 11E, 11F, 11G of the recording head 11.

The pigment concentrations of the light pigment inks are set to ½ or less of those of the dark pigment inks in terms of weight %.

The platen 15 is arranged below the guide shaft 12 in parallel with the guide shaft 12. As an example, the platen 15 is formed of the material such as expandable resin, cloth, cotton, sponge, or the like.

Figure 2:
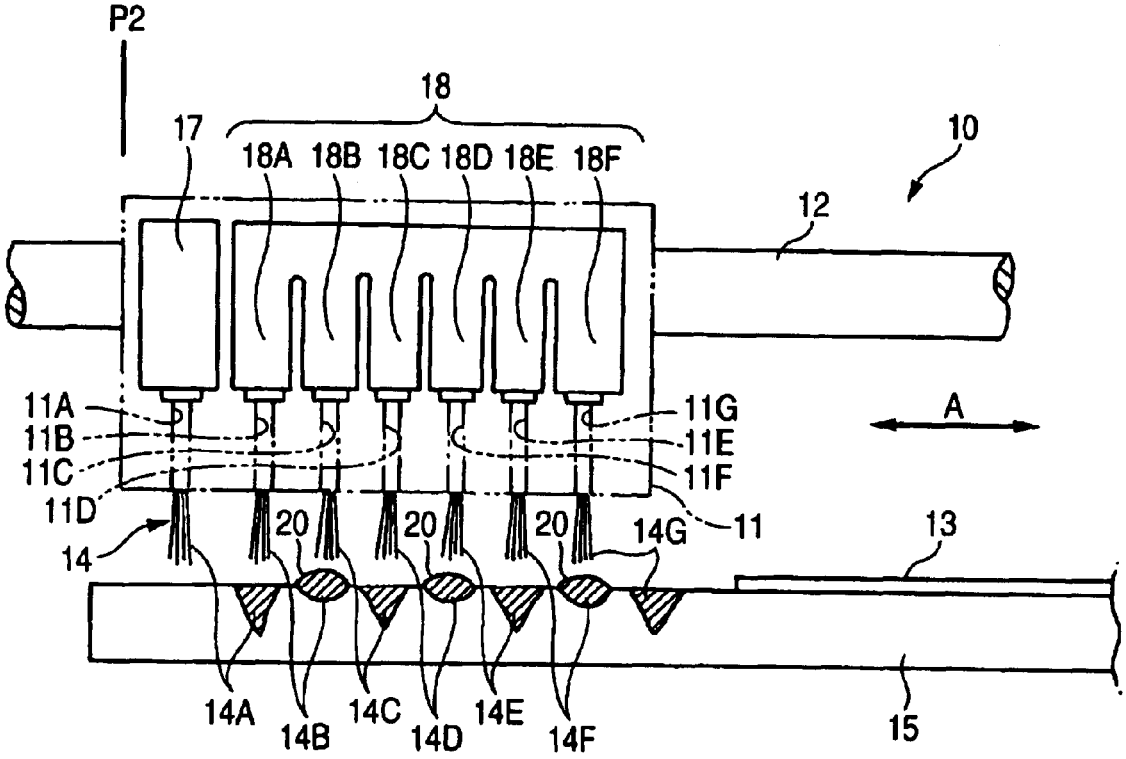
FIG. 2 is an explanatory view showing an ink jet recording method according to the present invention.

In the ink jet recording apparatus 10 that is constructed in this manner and that employs the inks each using a pigment as a respective coloring agent, the recording head 11 is scanned along the guide shaft 12 to move to the flushing box positions every time when the recording head 11 performs its reciprocating movement several times (4 to 5 times) along the main scanning direction indicated by the arrow A, and then, onto the dark pigment inks 14B, 14D, 14F flushed at a first flushing position P1, the light pigment inks 14C, 14E, 14G having the same hues as the dark pigment inks 14B, 14D, 14F, respectively, can be flushed at a second flushing position P2 (see FIG. 2).

In this case, the dark pigment inks 14B, 14D, 14F having the same hues as the light pigment inks 14C, 14E, 14G may be flushed at the second flushing position P2 after the light pigment inks 14C, 14E, 14G are flushed at the first flushing position P1.

In other words, the order of flushing of the dark pigment inks 14B, 14D, 14F and the light pigment inks 14C, 14E, 14G may be set arbitrarily and selected appropriately.

Also, the dark pigment inks 14B, 14D, 14F and the light pigment inks 14C, 14E, 14G are not necessarily set to an alternately flushing mode. Specifically, the light pigment inks 14C, 14E, 14G may be flushed several times per one flushing of the dark pigment inks 14B, 14D, 14F, or the dark pigment inks 14B, 14D, 14F may be flushed several times per one flushing of the light pigment inks 14C, 14E, 14G.

A desired effect can be obtained, for example, by carrying out thrice flushing of the dark pigment inks 14B, 14D, 14F per one flushing of the light pigment inks 14C, 14E, 14G.

In this embodiment, as an example, the pigment inks having the same hues are combined with each other such that the light pigment ink 14C of cyan is flushed onto the dark pigment ink 14B of cyan, the light pigment ink 14E of magenta is flushed onto the dark pigment ink 14D of magenta, and the light pigment ink 14G of yellow is flushed onto the dark pigment ink 14F of yellow. However, there is no necessity that the dark pigment inks 14B, 14D, 14F and the light pigment inks 14C, 14E, 14G should have the same hues, respectively.

That is, for example, the dark pigment ink 14B of cyan and the light pigment ink 14G of yellow may be flushed onto the flushing portion of the platen 15 in any order.

Figure 3:
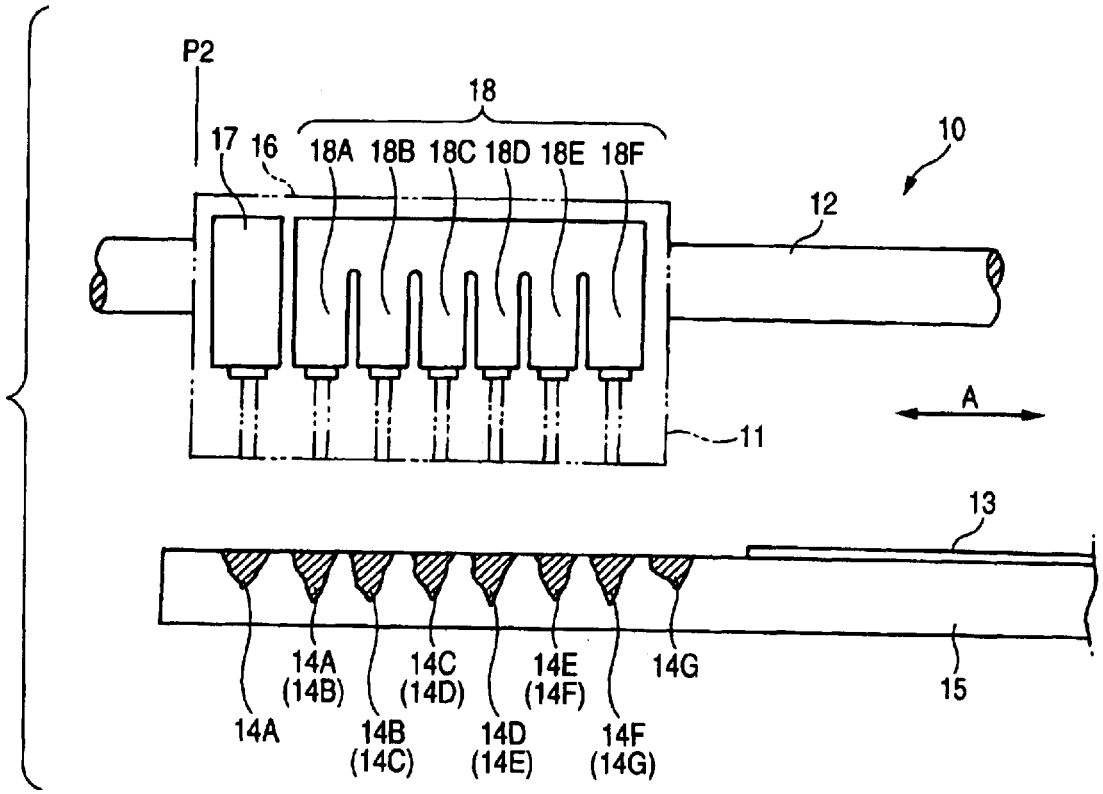
FIG. 3 is another explanatory view showing the ink jet recording method according to the present invention.
Figure 4:
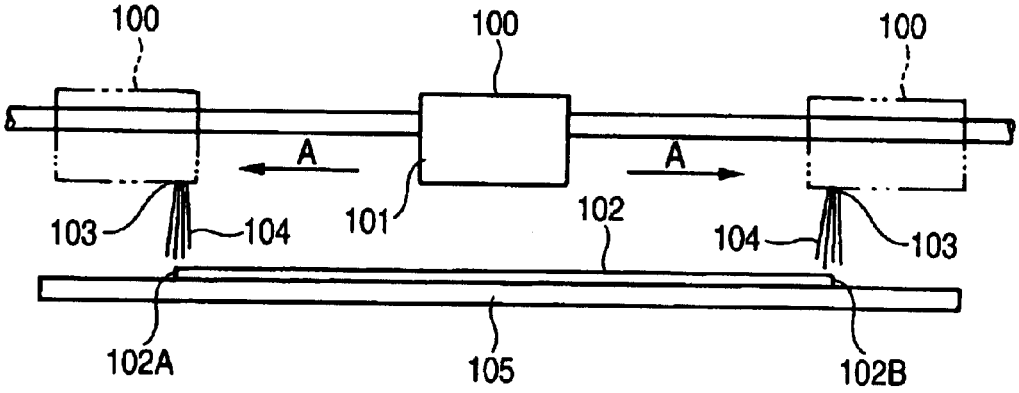
FIG. 4 is an explanatory view showing an ink jet recording method according to the background art.
Figure 5:
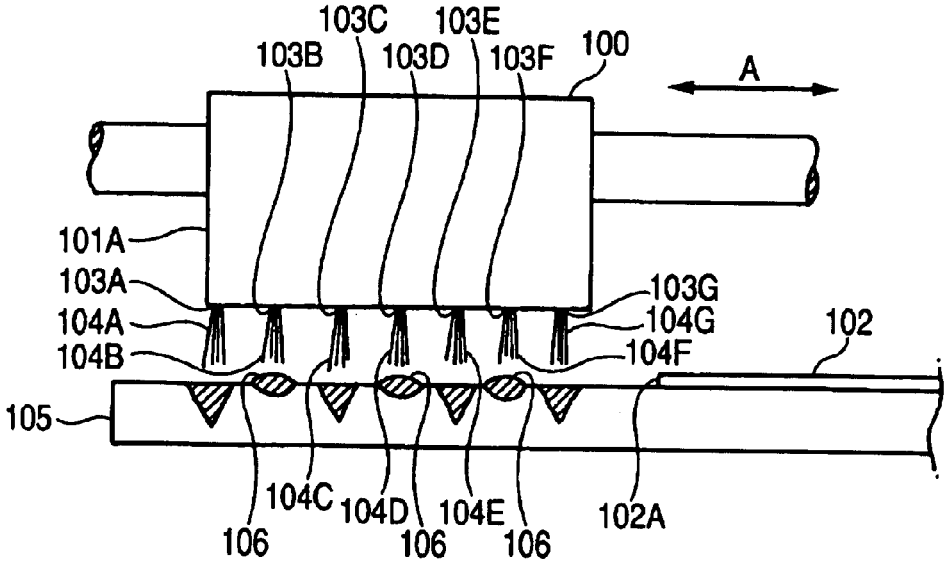
FIG. 5 is another explanatory view showing an ink jet recording method according to the background art.

Next, a flushing method in the ink jet recording apparatus 10 will be explained with reference to FIG. 1 to FIG. 3 hereunder.

As shown in FIG. 1, the recording head 11 is moved along the guide shaft 12 to place the recording head 11 at the first flushing position P1 on the outside of a recording paper 13, and then the pigment inks 14 (14A to 14G) are caused to flush onto the flushing portions of the platen 15 from respective nozzles 11A to 11G of the recording head 11.

In order to prevent the clogging of respective nozzles 11A to 11G of the recording head 11, this flushing is carried out every time when the reciprocating movement of the recording head 11 is performed by several cycles (4 to 5 cycles).

Here, if the room temperature in the operating circumstances of the ink jet recording apparatus 10 employing the pigment inks rises, especially, in the summer season, etc., the moisture contained in the pigment inks 14 (14A to 14G) that are flushed onto the flushing portions (boxes) of the platen 15 evaporates.

Particularly, because the weight percents of pigment solid components in the dark pigment inks 14B, 14D, 14F of cyan, magenta and yellow are higher than those of the light pigment inks 14C, 14E, 14G, such pigment solid components start precipitation.

Thus, in some cases the dark pigment inks 14B, 14D, 14F of cyan, magenta and yellow cannot penetrate sufficiently into the flushing portions (boxes) of the platen 15. Thus, the pigment solid components in the dark pigment inks 14B, 14D, 14F of cyan, magenta and yellow are deposited on the surface of the platen 15 as the piled-up sediment 20.

Therefore, as shown in FIG. 2, the recording head 11 is positioned at the second flushing position P2, and then, for example, the light pigment inks 14C, 14E, 14G having the same color hues as the dark pigment inks 14B, 14D, 14F, respectively, are flushed onto the same positions as the flushing portions (boxes) on the platen 15, onto which the dark pigment inks 14B, 14D, 14F are flushed.

The weight percents of the pigment solid components in the light pigment inks 14C, 14E, 14G of cyan, magenta and yellow are lower than those of the dark pigment inks 14B, 14D, 14F. Hence, further deposition of the pigment solid components of the dark pigment inks 14B, 14D, 14F can be prevented by solvent components constituting the light pigment inks 14C, 14E, 14G of cyan, magenta and yellow, before the pigment solid components in the dark pigment inks 14B, 14D, 14F of cyan, magenta and yellow form piled-up sediments. Further, as shown in FIG. 3, the dark pigment inks 14B, 14D, 14F can be allowed to penetrate into the flushing portions (boxes) of the platen 15 together with the light pigment inks 14C, 14E, 14G of cyan, magenta and yellow.

As a result, deposition of the dark pigment inks 14B, 14D, 14F of cyan, magenta and yellow on the surface of the platen 15 as the piled-up sediment 20 can be prevented.

Accordingly, it can be prevented that, after the deposition proceeds, such deposition rubs surfaces of the nozzles 11A to 11G of the recording head 11 to cause the defective ejection when the recording head 11 comes to the flushing position at a certain time.

Although the above illustration has been made with reference to the case that the dark/light inks 14B, 14C of cyan, the dark/light inks 14D, 14E of magenta, and the dark/light inks 14F, 14G of yellow are used as the color inks, the dark/light inks of the color inks are not limited thereto. This applies similarly to the black ink.

In addition, the present invention is not limited to the above embodiment, and appropriate variation, improvement, etc. may be applied. Materials, shapes, dimensions, modes, numbers, arranged locations, thickness dimensions, etc. of the recording head, the guide shaft, the platen, etc. exemplified in the above embodiment may be selected and not limited to the above so long as they can implement the present invention.

The present invention will be illustrated in greater detail with reference to the following Examples, but the invention should not be construed as being limited thereto.

As the platen 15 in Example and Comparative Example, the foamed material such as a sponge or the like was employed.

Also, as the pigment inks in Example and Comparative Example, the dark/light pigment inks of cyan, the dark/light pigment inks of magenta, and the dark/light pigment inks of yellow were filled in the cyan cartridges 18A, 18B, the magenta cartridges 18C, 18D, and the yellow cartridges 18E, 18F, respectively.

As the black ink, the original ink for the ink jet printer PM950C (manufactured by Seiko Epson Corporation) was employed.

As the magenta dark pigment ink, employed was an ink containing 5 wt % of C.I pigment red 122, 15 wt % of glycerin, 5 wt % of triethylene glycol monobytyl ether, 1 wt % of Olfin E1010 (acetylene glycol series surfactant manufactured by Nissin Chemical Co., Ltd.), 1 wt % of triethanolamine, and the rest of pure water to make 100 wt %.

As the cyan dark pigment ink, employed was an ink containing 5 wt % of C.I pigment blue 15:3, 15 wt % of glycerin, 5 wt % of triethylene glycol monobytyl ether, 1 wt % of Olfin E1010 (acetylene glycol series surfactant manufactured by Nissin Chemical Co., Ltd.), 1 wt % of triethanolamine, and the rest of pure water to make 100 wt %.

As the yellow dark pigment ink, employed was an ink containing 5 wt % of C.I pigment yellow 74, 15 wt % of glycerin, 5 wt % of triethylene glycol monobytyl ether, 1 wt % of Olfin E1010 (acetylene glycol series surfactant manufactured by Nissin Chemical Co., Ltd.), 1 wt % of triethanolamine, and the rest of pure water to make 100 wt %.

On the other hand, as the magenta light pigment ink, employed was an ink containing 2 wt % of C.I pigment red 122, 25 wt % of glycerin, 5 wt % of triethylene glycol monobytyl ether, 1 wt % of Olfin E1010 (acetylene glycol series surfactant manufactured by Nissin Chemical Co., Ltd.), 1 wt % of triethanolamine, and the rest of pure water to make 100 wt %.

As the cyan light pigment ink, employed was an ink containing 2 wt % of C.I pigment blue 15:3, 25 wt % of glycerin, 5 wt % of triethylene glycol monobytyl ether, 1 wt % of Olfin E1010 (acetylene glycol series surfactant manufactured by Nissin Chemical Co., Ltd.), 1 wt % of triethanolamine, and the rest of pure water to make 100 wt %.

As the yellow light pigment ink, employed was an ink containing 2 wt % of C.I pigment yellow 74, 25 wt % of glycerin, 5 wt % of triethylene glycol monobytyl ether, 1 wt % of Olfin E1010 (acetylene glycol series surfactant manufactured by Nissin Chemical Co., Ltd.), 1 wt % of triethanolamine, and the rest of pure water to make 100 wt %.

Under the above conditions, the flushing was performed by one million passes in the circumstances of 40° C. and 20%.

EXAMPLE

When the light pigment inks were flushed onto the same positions as the flushing portions (boxes) of the platen 15 onto which the dark pigment inks were flushed, the piled-up sediments of the inks (pigments) were not generated on the flushing portions (boxes) of the platen 15. As a result, the stable ejection could be assured.

Comparative Example

Contrary, when respective pigment inks (the dark pigment inks, the light pigment inks) were flushed onto the flushing portions (boxes) located at predetermined positions respectively, piled-up sediments of the inks (pigments) were generated on the flushing portions (boxes) at the ten thousandth pass, which rubbed the nozzle surfaces of the recording head at a later flushing to cause defective ejection (dot omission).

As described above, according to the present invention, the first flushing for flushing one of the dark pigment ink(s) and the light pigment ink(s) and the second flushing for flushing the other of the dark pigment ink(s) and the light pigment ink(s) are performed onto the same position(s) of the platen.

Thereby, deposition of the pigment solid components of the dark pigment inks on the surface of the flushing portions (boxes) of the platen as piled-up sediments can be prevented before happens by the solvent components constituting the light pigment inks.

As a result, it can be prevented that, after the deposition proceeds, such deposition rubs surfaces of the nozzles of the recording head to cause the defective ejection when the recording head comes to the flushing position at a certain time.

This application is based on Japanese Patent Application No.2001-399828, the contents thereof being herein incorporated by reference.

While the invention has been described in detail and with reference to specific embodiment thereof, it will be apparent to one skilled in the art that various changes and modifications can be made therein without departing from the spirit and scope thereof.

What is claimed is:

1. An ink jet recording apparatus that employs inks using pigments as coloring agents and moves a recording head along a guide shaft to flush the inks to flushing portions of a platen, wherein the recording head performs a first flushing for flushing one of dark pigment ink(s) and light pigment ink(s) and a second flushing for flushing the other of the dark pigment ink(s) and the light pigment ink(s) onto the same position(s) of the platen.

2. A flushing process for an ink jet recording apparatus that employs inks using pigments as coloring agents and moves a recording head along a guide shaft to flush the inks to flushing portions of a platen, the process comprising performing a first flushing for flushing one of dark pigment ink(s) and light pigment ink(s) and a second flushing for flushing the other of the dark pigment ink(s) and the light pigment ink(s) onto the same position(s) of the platen.

* * * * *